US008499378B2

(12) United States Patent
Kelly et al.

(10) Patent No.: US 8,499,378 B2
(45) Date of Patent: Aug. 6, 2013

(54) PEDESTAL END FOR PATIENTS BED

(75) Inventors: William Beattie Kelly, Nyora (AU); David Bird, Nyora (AU)

(73) Assignee: Maxi-Care Promotions Pty. Ltd. (AU)

( * ) Notice: Subject to any disclaimer, the term of this patent is extended or adjusted under 35 U.S.C. 154(b) by 632 days.

(21) Appl. No.: 12/758,046

(22) Filed: Apr. 12, 2010

(65) Prior Publication Data

US 2010/0263120 A1 Oct. 21, 2010

(51) Int. Cl.
*A47C 31/00* (2006.01)

(52) U.S. Cl.
USPC ..... 5/11; 5/509.1; 5/660; 5/610; 5/611

(58) Field of Classification Search
USPC ..... 5/509.1, 660, 610, 11, 611
See application file for complete search history.

(56) References Cited

U.S. PATENT DOCUMENTS 578,844 A * 3/1897 Storr ..... 5/50
1,481,756 A * 1/1924 Stickle ..... 5/617
2,448,317 A * 8/1948 Lineberry et al. ..... 5/100
2,555,160 A * 5/1951 Schwarz ..... 5/93.1
3,240,935 A * 3/1966 Dougall ..... 5/601
3,365,731 A * 1/1968 Royce ..... 5/100
4,271,830 A * 6/1981 Moon ..... 606/244
4,458,370 A * 7/1984 Fickler ..... 5/660
4,524,472 A * 6/1985 Foust ..... 5/611
4,711,230 A * 12/1987 Berke et al. ..... 606/237
4,856,129 A * 8/1989 Butler ..... 5/610
5,020,169 A * 6/1991 Hamada et al. ..... 5/10.2
5,363,520 A * 11/1994 Lyne, Jr. ..... 5/11
5,502,850 A * 4/1996 Lyne, Jr. ..... 5/11
5,566,412 A * 10/1996 Arnold ..... 5/610
5,613,255 A * 3/1997 Bish et al. ..... 5/611
5,615,431 A * 4/1997 Vassilli ..... 5/610
6,315,319 B1 * 11/2001 Hanson et al. ..... 280/650
6,427,263 B1 * 8/2002 Lindell ..... 5/86.1
6,516,478 B2 * 2/2003 Cook et al. ..... 5/611
6,779,210 B1 * 8/2004 Kelly ..... 5/611
6,957,456 B2 * 10/2005 Darling et al. ..... 5/509.1
7,302,716 B2 * 12/2007 Snyder et al. ..... 5/11
7,428,760 B2 * 9/2008 McCrimmon ..... 5/611
7,437,786 B2 * 10/2008 Bellingroth ..... 5/611
7,624,463 B2 * 12/2009 Graham et al. ..... 5/658
7,757,313 B2 * 7/2010 Koorey ..... 5/11
8,136,185 B2 * 3/2012 Olszewski ..... 5/611
8,234,729 B2 * 8/2012 Yvernault et al. ..... 5/611
2004/0148698 A1 * 8/2004 Snyder et al. ..... 5/11
2005/0223491 A1 * 10/2005 McCrimmon ..... 5/11
2007/0083992 A1 * 4/2007 Lindner et al. ..... 5/611
2009/0282616 A1 * 11/2009 Carr ..... 5/611
2010/0263120 A1 * 10/2010 Kelly et al. ..... 5/11
2010/0293709 A1 * 11/2010 Koorey ..... 5/11
2011/0197357 A1 * 8/2011 Koorey ..... 5/11
2012/0304378 A1 * 12/2012 Koorey ..... 5/11

* cited by examiner

*Primary Examiner* — Robert G Santos
*Assistant Examiner* — David E Sosnowski
(74) *Attorney, Agent, or Firm* — Galbreath Law Offices, P.C.; John A. Galbreath

(57) ABSTRACT

A hollow pedestal bed end for a rise and fall patient's bed is made of reduced width to fold over the mattress frame and pass through a door opening. The inner faces of the paired bed ends each have a slot through which a mattress frame bracket projects. A wheeled carriage inside the bed end rides on an upright guide and the bracket projects from the guide. The rise and fall motion is supplied by a linear actuator whose small movements are multiplied by a third order lever. The frame is thus lifted by a pair of such pedestal ends.

11 Claims, 4 Drawing Sheets

PEDESTAL END FOR PATIENTS BED

FIELD OF THE INVENTION

This invention concerns patients beds used in nursing establishments and old peoples homes.

BACKGROUND OF THE INVENTION

Such beds have a rise and fall facility and frequently also have a folding facility so that the patient can be given inclined back support or lie in a position with the head higher than the feet.

The rise and fall motion is commonly provided by actuators which rely on a telescopic unit powered by screw and nut mechanism. Linak NS of Denmark supply such linear actuators.

In our Patent No. 2002301101 we describe rise and fall patients beds in which a wheeled carriage has a pair of lugs which project through a pair of slots in the front face of a generally planar bed head enclosed in sheet steel. Such carriages descend almost to the floor level and have an electrically driven screw which raises and lowers the carriage. The carriage rises to care height, namely the level at which it is comfortable for staff to handle a patient without stooping. While being reliable and constructionally stable, the bed ends are as wide as the mattress frame, namely 900 mm and 1000 mm high. Thus passage through doors is only possible if the ends are detached from the mattress frame so that the mattress can be turned on its side. The mechanism tends to be noisy and slow taking 40-50 seconds to execute the full range of movement.

SUMMARY OF THE INVENTION

In its broadest aspect the invention provides a bed pedestal end for a rise and fall patients bed, comprising a body, upright guide means in the body, a mattress frame support which rises and falls on the guide means, a drive system in the body which multiplies small actuator movement to produce the required range of movement in the mattress frame support.

More particularly, the inventions apparatus aspect provides a bed end for a rise and fall patients bed, comprising a body, upright guides in the body which extend from floor level to care height, a mattress frame support with means to attach the support to a mattress frame which is moveable in the guides, a lever pivoted to the body alongside the guides which applies to lift the frame support, an actuator connected between the lever and the body such that the lever multiplies the actuator motion to exert the required range of rise and fall.

The mattress frame support may be a carriage with pairs of wheels. The wheels may be of V-section. Flanged wheels are also useful.

The upright guides may be a pair of mutually parallel tracks which extend between upper and lower horizontal structural members of the body.

The mattress frame support may project through an upright slot in the body of the bed pedestal. The slot may lie at or near the central vertical axis of the bed end.

The frame support may have a plate projecting through the slot at 90E to the plane of the body. The plate may have bolt holes for connection to brackets fixed to the end of the mattress support frame.

The lever may be part of a third order system. The lever may be arcuate in shape and free to roll under a rotatable follower extending from the carriage. The lever may be shaped to impose a relatively constant load on the actuator as the lever tilts from a floor position to a maximum height position.

The actuator may be hydraulic, pneumatic or screw driven. Actuators in which an electrically driven screw drives a nut inside a telescoping tube are convenient for this purpose.

The lever may have a straight leg with a pivot at one end and a C-shaped leg extension at the opposite end. This shape imposes minimal side thrust on the carriage as the lever raises the carriage. The lever may be mounted on a stile fixed parallel to the guides between the upper and lower horizontal structural parts of the body. The arrangement of the lifting mechanism side by side with the guides and carriage permits the body of the bed end to be narrower than the bed ends of the prior art.

BRIEF DESCRIPTION OF THE DRAWINGS

One embodiment of the invention is now described with reference to the accompanying drawings, in which.

DETAILED DESCRIPTION WITH RESPECT TO THE DRAWINGS

Figure 1:
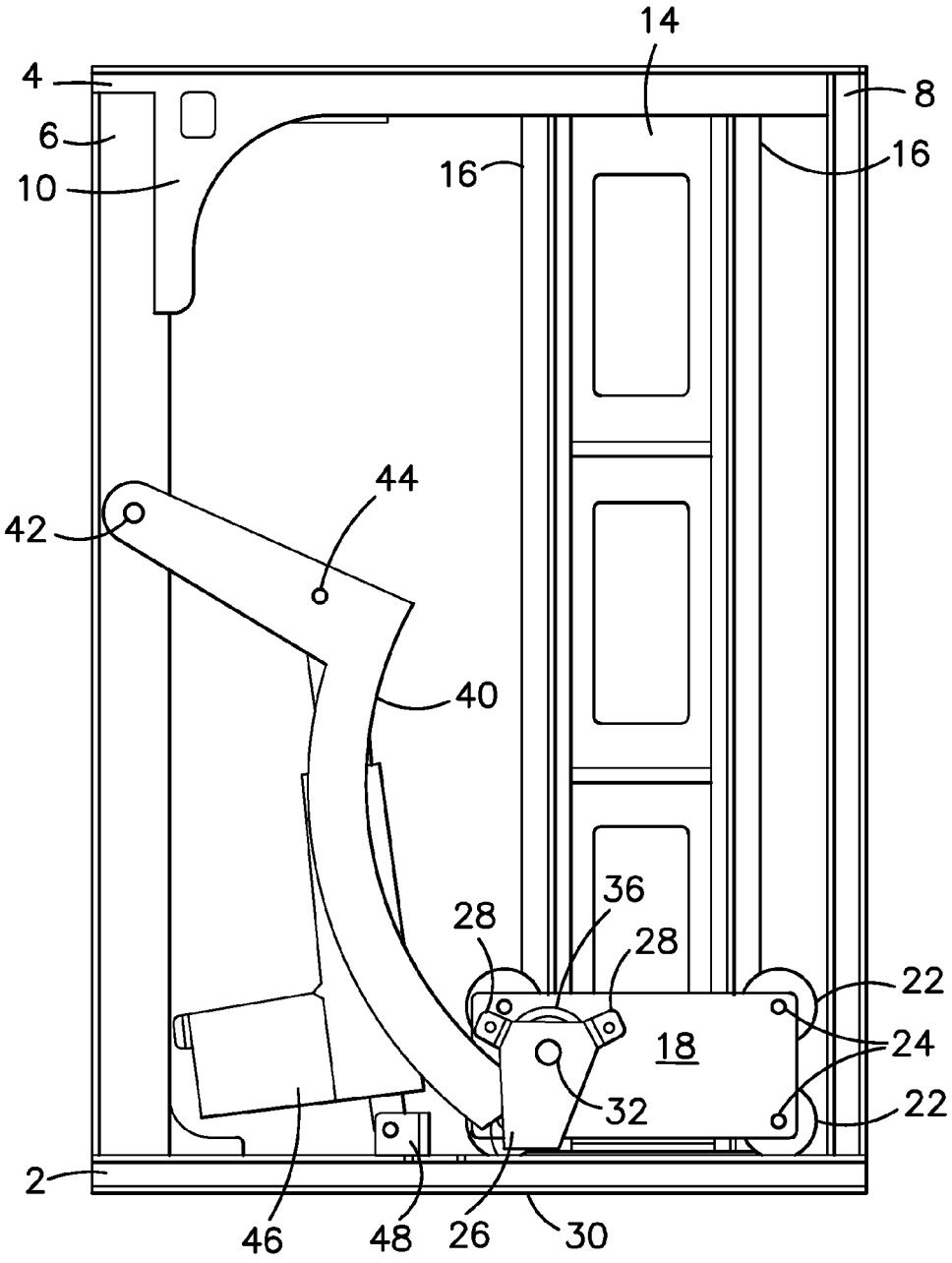
FIG. 1 is a front view of the lifting mechanism with the sheet metal cover removed.
Figure 2:
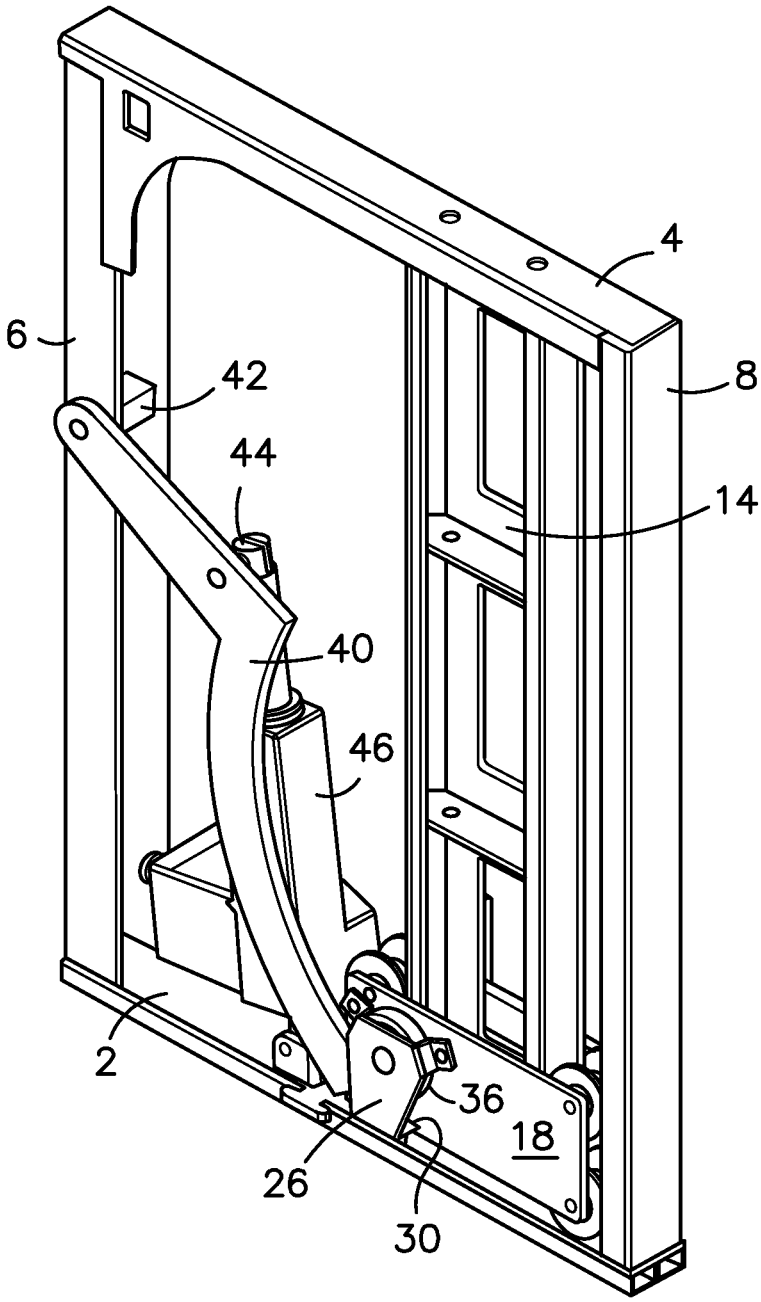
FIG. 2 is a perspective of FIG. 3.
Figure 3:
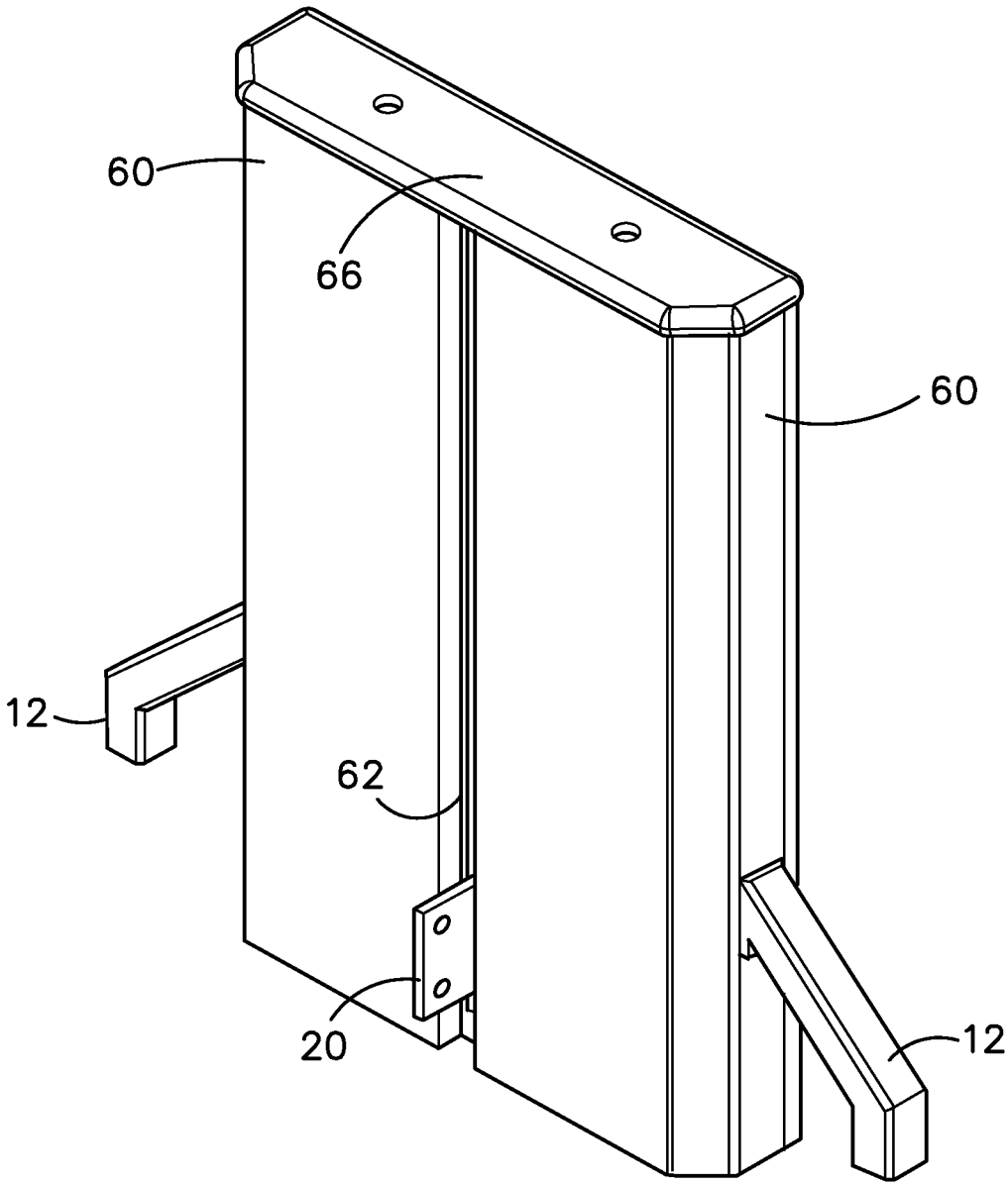
FIG. 3 is a perspective of the pedestal before wheels are attached.

Referring to FIGS. 1-3, the pedestal frame is made from a rectangular section base tube 2, a top channel section rail 4 supported by a channel section pivot stile 6 and a rectangular section stile 8. Pivot stile 6 has a gusset 10. A pair of inclined outriggers 12 extend from the two stiles and the lower ends act as sockets for the reception of castor wheels (not shown). The welded rectangular steel frame components are made of 3 mm sheet steel. The frame is 520 mmW×743 mm H.

A carriage guide 14 lies off-centre and consists of an upstanding sheet of 3 mm steel with two sides 16 bent to form a V-section edge. The guide lies inside the upper top channel section rail and is welded to the top and bottom rails. The carriage 18 is an 8 mm plate which acts as a lift wheel support and bent at 90E to form a projecting mattress frame support bracket 20 (see FIG. 3).

Four V-section wheels 22 revolve on axles 24 projecting from the corners of the plate. The wheels 22 ride up and down the guides and rest on the base tube rail 2 when the mattress frame is in the floor position, namely the lowest extent of its travel.

The outer face of the carrier plate 18 carries a triangular bearing plate 26 spaced from the carrier plate by brackets 28 and foot 30. Stub axle 32 spans the gap between the parallel plates and lies alongside the guide closest to the pedestal centre. Stub axle 32 carries grooved wheel 36 and lies in the path of steel arm 38 which is pivoted 445 mm up pivot stile 6. Arm 38 has a straight portion and a curved portion 40 which is concave with respect to grooved lift wheel 36 and terminates just beyond it. The arm pivot 42 in the pivot stile is 281.5 mm from the centre of the grooved wheel 36.

The arm 38 has a thrust pin 44 lying 140 mm from the pivot pin 42 close to the confluence of the straight portion and the curved position. An electrically driven LINAK® screw actuator 46 is pivotally mounted on bracket 48 fixed to base tube 2 between the carriage and the pivot stile 6. The thrust arm applies force to the arm which underlies grooved wheel 36 and when the actuator elongates wheel 36 rotates and carriage 18 rises.

The arrangement is a third order lever, the actuator pivot being laterally displaced 200 mm from the stile pivot 42.

Mechanical advantage is not as important as compactness of the mechanism and initially the actuator draws four amps falling to two amps as the carriage reaches the working height of the mattress frame, namely 500 mm.

Figure 4:
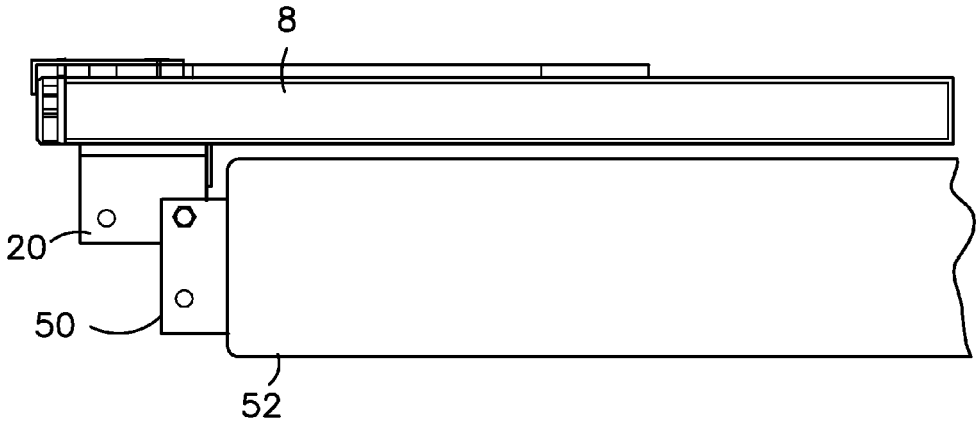
FIG. 4 is a side view of the pedestals with one partially disconnected from the mattress frame showing how the pedestals may tilt parallel to allow passage through a doorway.

Referring now to FIG. 4, the bracket 20 has a pair of bolt holes at 60 mm centres which allows connection to the pair of brackets 50 projecting from the end of the mattress frame 52.

Figure 5:
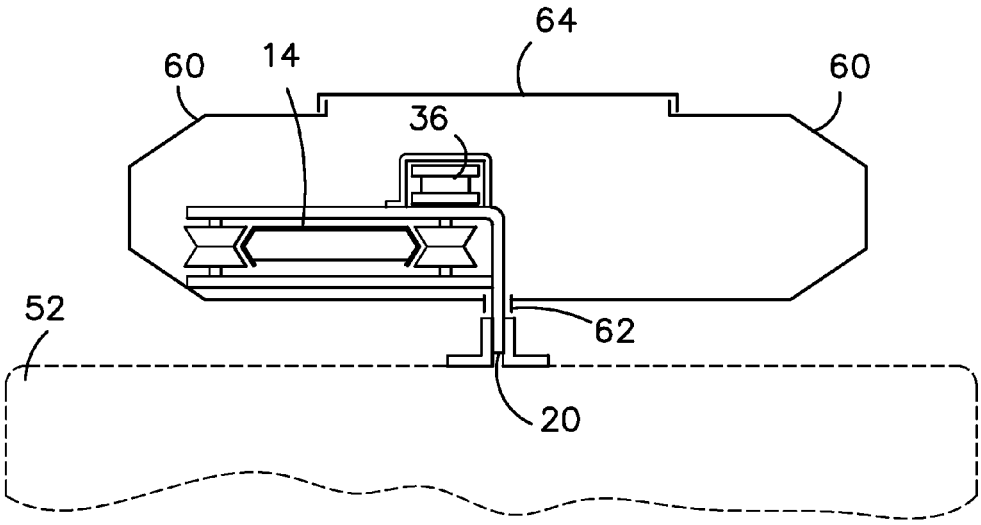
FIG. 5 is a sectional plan showing the way in which the sheet metal covers and door enclose the pedestal.

Referring now to FIG. 5, the pedestal frame is enclosed by sheet steel covers 60 which embrace the sides of the frame and extending around the inner face where together they define a central slot 62 (see FIG. 4). The purpose of the slot which extends the full height of the pedestal (743 mm) is to allow the mattress frame bracket 20 to protrude and be accessible for bolting to the mattress frame.

The covers wrap the sides of the frame and extend to the opposite face of the pedestal which is closed by removable access panel 64. This allows servicing of the working parts. The top of the frame is covered by a polished timber batten 66. Outriggers 12 are secured to the stiles by bolts.

We have found the advantages of the above embodiment to be:

1. Reduction in size means that the pedestal width plus wheels stays within the 900 mm width of the mattress frame.

2. The folding of the bed ends on to the face of the mattress and frame allows the bed to be turned on its side as a unit and, if placed on a furniture skate, can be wheeled through doors.

3. Quietness and speed of operation. The mattress frame moves from floor to maximum height in 20-30 seconds.

It is to be understood that the word "comprising" as used throughout the specification is to be interpreted in its inclusive form, ie. use of the word "comprising" does not exclude the addition of other elements.

It is to be understood that various modifications of and/or additions to the invention can be made without departing from the basic nature of the invention. These modifications and/or additions are therefore considered to fall within the scope of the invention.

What is claimed is:

1. A bed end for a rise and fall patients bed which is operable to drive a mattress frame support between floor level and care height, comprising a body, upright guides in the body which extend from floor level to care level, a mattress frame support which is movable in the guides, attachment means on the mattress frame support for connection to a mattress frame, a lever pivotally connected to the body alongside the guides, the lever applying force to lift the mattress frame support, and an actuator connected between the lever and the body such that a motion of the actuator is multiplied by the lever into a greater motion of the mattress frame support, to exert a required range of rise and fall.

2. A bed pedestal as claimed in claim 1, wherein the mattress frame support is a carriage with pairs of wheels.

3. A bed pedestal as claimed in claim 2, wherein the body has an upper horizontal structural part and a lower horizontal structural part and the upright guides and a pair of tracks parallel to each other which extend between the parts.

4. A bed pedestal as claimed in claim 1, wherein the body has an upright face which defines a slot and the attachment means is a projection which extends through the slot.

5. A bed pedestal as claimed in claim 4, wherein the projection is a bracket which projects through the slot at 90 degrees to the face for attachment to a mattress frame.

6. A bed pedestal as claimed in claim 4, wherein the slot lies near a central vertical axis of the face.

7. A bed pedestal as claimed in claim 3, wherein the upright guides are parallel inturned edges of an upright plate, the edges being of V-section which act as tracks for V-section carriage wheels.

8. A bed pedestal as claimed in claim 2, wherein the lever is part of a third order lever system which is a lever system wherein an effort applied to the lever is closer to a fulcrum of the lever than is a load lifted by the lever, and wherein a distance moved by the load is greater than a distance moved by the effort.

9. A bed pedestal as claimed in claim 8, wherein the lever has two ends, and has a straight leg with a pivot at one end of the lever and a C-shaped leg extension at an opposite end of the lever.

10. A bed pedestal as claimed in claim 4, wherein the lever is mounted on a stile fixed parallel to the guides between the upper and lower horizontal structural parts of the body.

11. A bed pedestal for a patients rise and fall bed, comprising a body, upright guide means in the body, a mattress frame support which rises and falls in the guide means, an actuator which is attached to the body, the actuator being part of a drive system, wherein a motion of the actuator is multiplied by the drive system into a greater motion of the mattress frame support, to produce a required range of movement in the mattress frame support.

* * * * *